US009731865B2

(12) United States Patent
Heβ et al.

(10) Patent No.: US 9,731,865 B2
(45) Date of Patent: Aug. 15, 2017

(54) FLUID CONTAINER OF A HOUSEHOLD APPLIANCE

(71) Applicant: BSH Hausgeräte GmbH, München (DE)

(72) Inventors: Jürgen Heβ, Berlin (DE); Vladimir Proseanic, West Bloomfield, MI (US); Piotr Skierman, Pabianice (PL)

(73) Assignee: BSH Hausgeräte GmbH, München (DE)

( * ) Notice: Subject to any disclaimer, the term of this patent is extended or adjusted under 35 U.S.C. 154(b) by 18 days.

(21) Appl. No.: 14/625,948

(22) Filed: Feb. 19, 2015

(65) Prior Publication Data

US 2016/0244207 A1 Aug. 25, 2016

(51) Int. Cl.

| | |
|---|---|
| ***D06F 58/20*** | (2006.01) |
| ***B65D 25/14*** | (2006.01) |
| ***D06F 58/24*** | (2006.01) |

(52) U.S. Cl.

CPC ..... *B65D 25/14* (2013.01); *D06F 58/20* (2013.01); *D06F 58/24* (2013.01)

(58) Field of Classification Search

CPC .. F26B 5/00; F26B 19/00; F26B 21/00; F26B 21/06; D06F 58/00; D06F 58/20

USPC ..... 34/595, 601, 610; 68/5 R, 5 C, 19, 20; 8/149, 159; 210/752, 748.14

See application file for complete search history.

(56) References Cited

U.S. PATENT DOCUMENTS

| | | | | | |
|---|---|---|---|---|---|
| 2,036,949 | A * | 4/1936 | Meinzer | C25B 11/04 | 204/230.5 |
| 2,042,534 | A * | 6/1936 | Krause | A61L 2/238 | 204/194 |
| 2,086,324 | A * | 7/1937 | Feremutsch | A61L 2/238 | 204/218 |
| 2,096,011 | A * | 10/1937 | Smith | A23L 3/00 | 204/157.15 |
| 4,849,223 | A * | 7/1989 | Pratt | A01N 59/16 | 424/409 |
| 5,064,534 | A * | 11/1991 | Busch | B01J 47/002 | 210/266 |
| 6,890,953 | B2 * | 5/2005 | Arata | A01N 59/16 | 205/440 |
| 7,087,572 | B2 * | 8/2006 | Hubig | C11D 1/521 | 510/501 |
| 7,435,438 | B1 * | 10/2008 | Arata | A23B 4/20 | 426/321 |
| 7,591,038 | B2 * | 9/2009 | Murray | D06F 33/02 | 68/12.08 |
| 7,799,234 | B2 * | 9/2010 | Dooley | A61L 11/00 | 205/742 |
| 7,921,578 | B2 * | 4/2011 | McAllister | D06F 35/00 | 134/10 |

(Continued)

FOREIGN PATENT DOCUMENTS

| | | | | |
|---|---|---|---|---|
| GB | 656006 A * | 8/1951 | ..... | D06F 58/10 |
| JP | 2004097467 A * | 4/2004 | | |

(Continued)

*Primary Examiner* — Stephen M Gravini

(74) *Attorney, Agent, or Firm* — Jordan IP Law, LLC; Todd A. Vaughn

(57) ABSTRACT

A fluid container of a household appliance, the fluid container having a retaining region to hold fluid and which has at least one oligodynamic surface, and a household appliance that includes on such fluid container.

17 Claims, 3 Drawing Sheets

(56) References Cited

U.S. PATENT DOCUMENTS

| | | | | |
|---|---|---|---|---|
| 2008/0195033 | A1* | 8/2008 | Eagleson | A61K 33/24 604/21 |
| 2011/0290740 | A1* | 12/2011 | Dooley | A61L 11/00 210/752 |
| 2013/0084371 | A1* | 4/2013 | Eaton | A23L 3/005 426/244 |
| 2013/0255095 | A1* | 10/2013 | Bommels | D06F 58/24 34/85 |
| 2013/0340797 | A1* | 12/2013 | Bommels | D06F 39/10 134/34 |
| 2016/0244207 | A1* | 8/2016 | He | B65D 25/14 |

FOREIGN PATENT DOCUMENTS

| | | | | |
|---|---|---|---|---|
| JP | EP 1932962 | A1 * | 6/2008 | D06F 25/00 |
| KR | WO 2007058479 | A1 * | 5/2007 | D06F 25/00 |
| KR | 20120071629 | A * | 7/2012 | |

* cited by examiner

FLUID CONTAINER OF A HOUSEHOLD APPLIANCE

TECHNICAL FIELD

Embodiments relates to a fluid container of a household appliance which comprises a retaining region for holding fluid. Embodiments also relate to a household appliance comprising at least one fluid container. Embodiments are particularly advantageous for condensate containers of clothes dryers.

BACKGROUND

If water is stored over longer periods of time in a container, microbe cultures may form and grow even in the case that there is only a poor presence of nutrient matter. Development of microbe cultures is visible as a formation of bio-films. Bio-films exhibit a jelly-like consistence. In many cases, the occurrence of bio-films is associated with a nauseous appearance and with a disturbing smell. In the worst case, a health hazard cannot be ruled out.

In laundry dryers, fluff is inevitably formed in a drum during a drying process because of a friction or rubbing of clothes or laundry pieces with each other. This fluff is swept along with the process air. If the process air is cooled down to reduce its absolute humidity, it condensates such that part of the water contained by the process air is segregated as condensate. This condensate is temporarily stored in a condensate container before it is either discharged from the laundry dryer or reused, e.g. as a cleaning fluid for cleaning a filter and/or a heat exchanger.

Operation of the laundry dryer, however, may be affected by presence of the fluff. For example, the fluff attaches itself to surfaces of a heat exchanger during condensation, which reduces an efficiency of the heat exchanger. Also, the fluff may be swept along by the condensate and agglomerate in the condensate container. This, in turn, may lead to the formation of bio-films in the condensate container.

It is thus a desire to reduce the presence of fluff in the condensate container. The bio-film in the condensate container may act as kind of "glue" that promotes a further agglomeration of fluff. The agglomerated fluff may be the cause for other disadvantageous effects. For example, the agglomerated fluff may cause pumps to get blocked. It may also cause short circuiting of electrodes of a filling level sensor of the condensate container. All these effects may lead to customer service deployments, related costs and subsequent customer dissatisfaction.

To prevent fluff from reaching the condensate container, it is known to place fluff filters in a process air channel between the drum and the heat exchanger for cooling down the process air. This has the disadvantage that the fluff filter must be cleaned regularly to avoid blockage of the process air channel. To automatically perform this cleaning, a complex arrangement is necessary, e.g., comprising pressure pumps, separate fluid channels etc. Also, the fluff filters cannot completely withhold all fluff such that still a small portion of the fluff may reach the condensate container to act as culture medium for microbes.

It is known that very low concentrations of dissolved ions of certain elements, especially of Group Ib elements Cu, Ag and Au (also called copper elements) show a strong oligodynamic effect. The oligodynamic effect describes the fact that the presence of these elements inhibits or at least slows down a growth of the microbe cultures to a high extent.

The oligodynamic effect is e.g, used by the application of Ag ions for interior parts of a refrigerator to inhibit formation of microbe cultures inside the refrigerator and to avoid a nauseous appearance and/or to prevent accelerated spoiling of food. Other application of the oligodynamic effect is plant protection. Low concentrations of Cu act as a very effective protection against attacks by fungi. In another application, it is reported that Au as filling material in dental applications significantly reduces caries development.

U.S. Pat. No. 7,624,601 describes a water feeder which is configured to add low concentrations of oligodynamic material to the water used in washing machines in order to counteract the formation of microbes. A water feeding apparatus has an ion eluter and a shower emitter. The shower emitter receives water via a coupling pipe from the ion eluter, and sprays the water, in the form of a shower, onto laundry. Liquid droplets in the form of a shower are small and easy to dry, and thus produce crystals having smaller particles (with large surface areas), having more lattice defects, and easier to dissolve. With these crystals attached to the laundry, when the crystals make contact with moisture next time, the silver ion in the liquid droplets easily dissolves. Even when the laundry is made of water-repellent or hydrophobic cloth, the solution dries up on the surface of the cloth before water is repelled. Thus, even this type of laundry can benefit from the antimicrobial effect of the silver ion.

EP 2 079 870 B1 discloses an iron comprising a soleplate having a garment-contact surface, wherein the soleplate has means for accommodating an antimicrobial agent, wherein said means for accommodating an antimicrobial agent comprises said garment-contact surface, whereby said garment-contact surface accommodates said antimicrobial agent and is arranged for transferring the antimicrobial agent to a piece of garment.

EP 2 009 166 B1 discloses a control for an automatic washer to operate the washer through a wash cycle determined based upon various soils and stains in the substrate load to be washed with a wash liquor in a wash zone of the washer, the control comprising: a plurality of stain/soil type entrees, which can be at least one of selected and detected, and cleaned with a particular wash cycle, dispensing control over the addition of oxidizing agents to the wash liquor, wherein there is dispensing control over at least one wash liquor additive from the group consisting of detergents, chlorine bleaches, color safe bleaches, cleaning boosters, pre-wash stain removers, pre-wash chemistries, switchable or tunable surfactants, wrinkle guard, color finishes, water repellency, stain guard, functional finishes, fabric softeners, water softeners, fragrance, anti-static agents, drying aids, de-wrinkling chemistries, deodorizers, surfactants, emulsifiers, enzyme activated stain removers, sudsing agents, builders, anti-redeposition polymers, in-wash stain removers and perfumes, operational control over activators and deactivators for members of the additives group, the activators and deactivators being from the group consisting of thermal, biological, chemical, electromagnetic and mechanical actions, and operational control over the particular wash cycles using the dispensing control to dispense additives to the wash liquor at selected times during the wash cycle and operating the activators and deactivators at selected times during the wash cycle. A wash cycle comprising the steps: loading a wash machine with a substrate load for cleaning, selecting a wash cycle based on at least a stain/soil in the substrate load, contacting the substrate load with a wash liquor, dispensing a wash liquor additive into the wash liquor, wherein the group of additives consists of detergents, chlorine bleaches, color safe bleaches, cleaning boosters, oxidizing agents, pre-wash stain removers, pre-wash chemistries, switchable or tunable surfactants, wrinkle guard, color finishes, water repellency, stain guard, functional finishes, fabric softeners, water softeners, fragrances, antistatic agents, drying aids, de-wrinkling chemistries, deodorizers, surfactants, emulsifiers, enzyme activated stain removers, sudsing agents, builders, anti-redeposition polymers, in-wash stain removers and perfumes, and selectively activating or deactivating the dispensed additive with activators and deactivators, the activators and deactivators being from the group consisting of thermal, biological, chemical, electromagnetic and mechanical actions.

WO 2007/145451 A2 discloses a dryer and a method for controlling the same. The method for controlling a dryer includes a steam supply step for supplying steam generated in a steam generator to a dram, and a hot air supply step for supply hot air generated in a hot air heater to the drum. The method may have an advantageous effect of removing wrinkles efficiently.

U.S. Patent Publication No. 2010/0212369 A1 discloses a device for cleaning an evaporator of a condenser with condensation water. The device includes a condensation water pan that collects condensation water condensed from process air by the evaporator, and a collection container above the evaporator that receives the condensation water from the condensation water pan and that dispenses the condensation water with a gush onto the evaporator from a rinsing chamber of the collection container with a sudden opening of a closure part through a downpipe.

SUMMARY

Embodiments are provided to at least partially overcome the disadvantages of the prior art, and in particular, to provide an improved technology to inhibit and/or reduce the formation of microbe cultures, in particular of bio-films, in a household appliance. In accordance with embodiments, this is achieved by the features set forth in the independent claims. Advantageous embodiments are in particular disclosed in the dependent claims, the subsequent description, and the attached drawing.

In accordance with embodiments, a fluid container of a household appliance comprises a retaining region for holding fluid, which retaining region comprising at least one oligodynamic surface.

Thus, fluid held in the retaining region can come into contact with the oligodynamic surface such that the formation of microbes, and in particular, a bio-film, is inhibited or even fully prevented. The oligodynamic surface is thus a contact surface to contact the fluid.

This gives the further advantage that the fluid can be stored for a longer duration without fouling. Also, a removal of particles from the fluid container is facilitated since these particles are not "glued" together and/or to the fluid container.

In accordance with embodiments, the household appliance may in particular be an electrically operated appliance, e.g., a major appliance (or "white goods") or a small appliance.

The fluid held in the fluid container may be water or water-based with or without additives.

Additionally to the retaining region as such, the fluid container may comprise one or more sensors (e.g., a filling level sensor), a lid, a fluid inlet, a fluid outlet etc. At least the retaining region may have a pan-like form. The fluid container may be part of a bottom group of the household appliance.

An oligodynamic surface may be implemented by providing a wall or wall section of the fluid container to consist of the respective oligodynamic material. Also, the fluid container may comprise a layer of the oligodynamic material, e.g., in form of a metal sheet or film or a colloidal layer (e.g., comprising colloidal silver or copper), which is attached to a base body, e.g., made of plastic.

Attachment of a layer of the oligodynamic material may include at least partially gluing a film (e.g., a Cu film) to a base body. Alternatively, back side moulding of an oligodynamic layer (e.g., a Cu-coated film), spray-coating, vacuum coating or deposition by chemical or electrochemical reaction can be used. Also, the oligodynamic material (e.g., Cu, a Cu alloy or a Cu compound) can be coextruded with the plastic base material of the fluid container. The process of incorporating oligodynamic material to the fluid container, however, is not limited to a particular method or particular methods.

It is an advantageous embodiment that at least one oligodynamic surface comprises at least one element out of Group Ib of the periodic table. The Group Ib may also be called copper group. The metallic elements of group Ib have the advantage that they are readily available, easy to handle, and resistant. Of these elements, the use of copper (Cu) is preferred for its relatively low costs.

In general, an oligodynamic metal may be a pure metal or a metallic mixture like an alloy or a compound. A pure metal may be a metal having a purity of 90% or more, in particular of 95% or more, in particular of 98% or more, in particular of 99% or more. For example, pure copper, a Cu/Ag alloy or brass may be used.

That an oligodynamic surface comprises a certain element or elements, e.g. from group Ib, may comprise that the oligodynamic surface is made up only from this element(s). The oligodynamic surface may also comprise this element and these elements, resp., embedded in a matrix material.

In one embodiment, the at least one oligodynamic surface is a passive contact surface, i.e., a surface that is not designed to carry an electric current. The oligodynamic effect is thus solely achieved by its contact with and wetting by the fluid (which may also be called "passive decomposition"). This embodiment is particularly easy to implement and cost-effective. It is particularly useful where the fluid does not contain many nutrients for microbes and/or where a storage time of the fluid is short.

In another embodiment that the retaining region comprises at least one oligodynamic surface and at least one other electrode, wherein a current can be applied to at least one oligodynamic surface for its electrolytic decomposition (which may also be called "active decomposition"). In this case this at least one oligodynamic surface may be an active contact surface, i.e., a surface that is designed to carry an electric current. The oligodynamic effect is thus improved by reinforced contact of the fluid with the oligodynamic material due to a release of the oligodynamic material into the fluid. This embodiment is particularly useful where the fluid may contain many nutrients for microbes and/or where a storage time of the fluid may be long.

At least one other electrode or "counter-electrode" may or may not have an oligodynamic surface or be of oligodynamic material. The other electrode may in particular be positioned at a rim or margin of the fluid container, in particular if the oligodynamic electrode is a central electrode.

The electrodes for the active decomposition are electrically conducting. To achieve this, it is advantageous that the oligodynamic surface or oligodynamic material is metallic, in particular purely metallic, e.g., made of copper or a copper alloy.

To stay in practically constant contact with the fluid, it is an advantageous embodiment that at least one oligodynamic surface is located at a bottom of the retaining region. The contact with the fluid is then also independent from a filling level of the fluid. Another advantage is that particles (e.g., fluff) tend to sink down to aggregate at the bottom. The particles are thus near or even in direct contact to the oligodynamic surface which increases its effectiveness even further.

It is another advantageous embodiment that at least one oligodynamic surface is located at a central position of the bottom of the retaining region. This gives the advantage that the contact with the fluid is not restricted to a periphery of the fluid container but gets in contact with most of the fluid. In case of the active decomposition it is advantageous that this central oligodynamic surface or group of surfaces is an electrode. This ensures an especially uniform distribution of the oligodynamic material into the fluid.

It is another advantageous embodiment that the retaining region is predominantly covered by at least one oligodynamic surface. A predominant coverage may mean a nominal coverage of the retaining region of at least 50%, in particular of more than 50%. That means that, if the fluid is filled to the maximum filling level, at least 50% of the contacted surface of the retaining region is an oligodynamic surface. This enables a particularly effective use of the oligodynamic effect. The coverage may in particular amount to at least 60%, in particular to at least 70%, in particular to at least 80%, in particular to at least 90%, in particular to 100% (full coverage). If the coverage is not 100%, the oligodynamic surface may be a contiguous or a segmented oligodynamic surface, e.g. comprising several strip-like or patch-like portions.

In accordance with embodiments, a household laundry appliance comprises at least one fluid container as described hereinabove. The household laundry appliance may be embodied in analogy to the fluid container and achieves the same advantages.

It is advantageous for the oligodynamic effect of the active decomposition that the oligodynamic material is constantly released into the liquid in small but sufficient amounts to inhibit growth of microbe cultures. In particular, if the oligodynamic material is a metal material, the dissolution or release of small amounts of ions can be achieved by electrolytic application of small electrical currents to the oligodynamic material. In this case, it is very advantageous for a suppression of the microbe cultures that a sufficient amount of the oligodynamically effective ions exists and persists in the fluid for a sufficiently long time.

To avoid dissolution of the oligodynamic electrode during a lifetime of the household appliance, it is an embodiment that only a relatively weak electric current having an electrical charge between $10^{-9}$ (10 E-9) C and $3\cdot10^{-3}$ ($3\cdot10$ E-3) C is applied to the electrode. Advantageously, the current is a direct current of unidirectional flow of its electric charge. The direct current may be a constant current or a pulsating current. The pulsating current may be a PWM current. This amount of current may e.g., be applied each operating cycle and/or after passing of a predetermined length of time.

The application of the electrical current may be controlled by a control unit of the household appliance.

It is another advantageous embodiment that the household appliance is a clothes drying appliance, e.g., a tumble dryer or a washer/dryer combination. In the clothes drying appliance, the agglomeration of fluff can be suppressed or even completely prevented. However, the household appliance is not so restricted and may e.g. be a washing machine (e.g., to prevent fluff to agglomerate in a sump), a dishwasher, a coffee maker etc.

Particularly, if the household appliance is a clothes drying appliance, it is an embodiment that the at least one fluid container is a condensate container for collection condensate. This condensate may contain fluff (including hair etc.). Inhibition of the bio-film reduces agglomeration of the fluff in the condensate container, prevents blockage of a suction pump by fluff etc. The condensate container may be used to collect condensate coming from a heat exchanger. Alternatively or additionally, the condensate container may be a storage container to hold water to be used as cleaning fluid.

DRAWINGS

The above described features and advantageous of the present invention are now described in greater detail by means of schematic descriptions of several embodiments in combination with respective drawings.

DESCRIPTION

Figure 1:
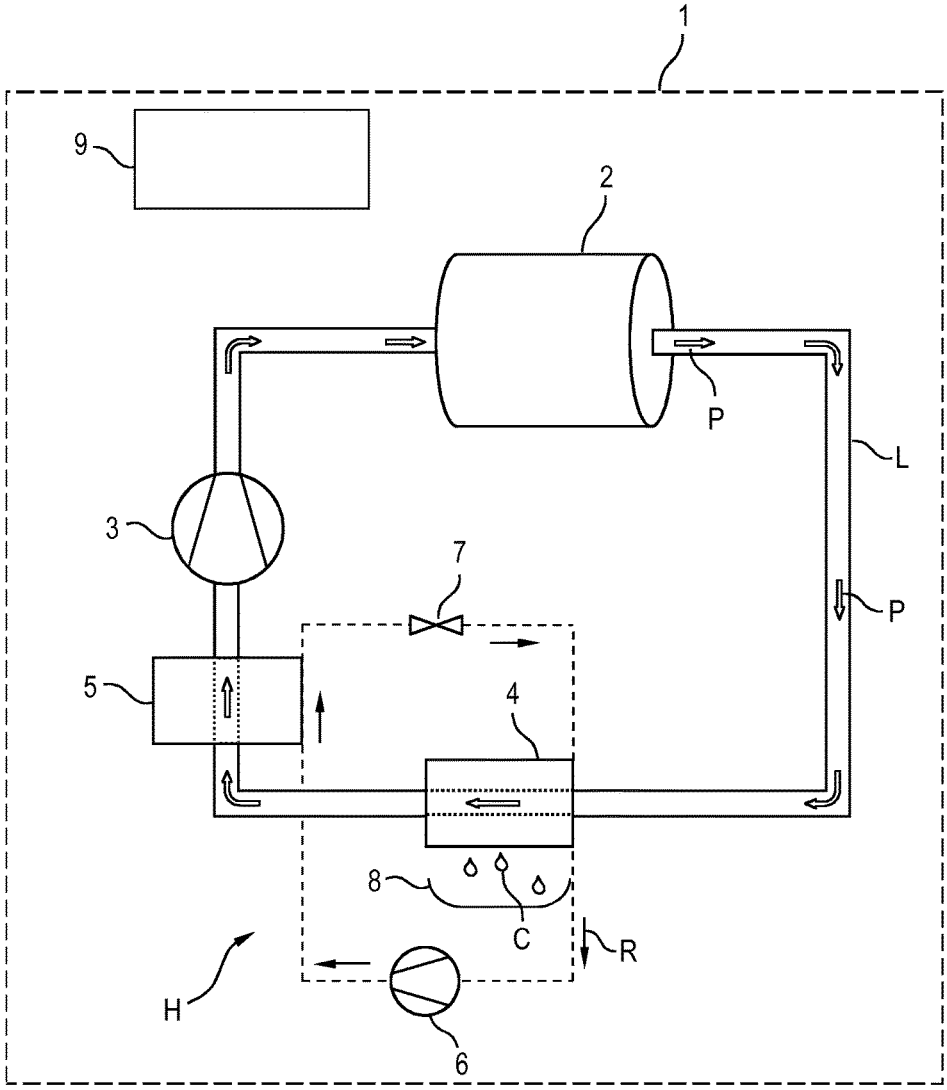
FIG. 1 illustrates a sketch of a household appliance comprising a fluid container, in accordance with embodiments.

FIG. 1 illustrates a heat pump clothes dryer 1 as a household appliance that comprises a closed cycle or closed loop L for circulating process air P. One component of this closed loop L is a drum 2 for receiving wet clothes or laundry that is to be dried. The process air P is circulated using a fan 3. For example, during a drying cycle, the process air P is discharged from the drum 2. At that point, the process air P has an intermediate temperature of about 40° C., a high absolute humidity, and a relative humidity of about 85%. The process air P then enters a heat exchanger that also acts as an evaporator 4 of a compressor-type heat pump H. There, the process air P is cooled down below its dew point such that condensate C is generated, in particular, by getting the process air P in contact with surfaces of the evaporator 4. The process air P discharged by the evaporator 4 thus has a relatively low temperature level of about 32° C., a significant lower absolute humidity, and a relative humidity close to its saturation point or being saturated, i.e. of about 100%. The process air P then enters a further heat exchanger that is also a condenser 5 of the heat pump H. When being discharged from the condenser 5, its temperature has been increased to a high temperature level of about 73° C. while keeping the absolute humidity constant. The relative humidity, however, drops to about 13%. This enables the process air P to absorb water from the wet clothes after re-entering the drum 2. By taking up water from the wet clothes, the relative humidity of the process air P is increased again to about 85%, and its temperature drops to the intermediate level. Since the process air P circulates in a closed loop, this process is repeated until the clothes reach a certain target humidity or target humidity rate.

A temperature difference between the heat exchangers (i.e., the evaporator 4 and the condenser 5) is generated due to the compressor-type heat pump H in which a fluid (or refrigerant R) is compressed by a compressor 6 from a superheated gas status at a low pressure/low temperature regime to a superheated gas status at high pressure/high temperature regime. At that high pressure, the refrigerant R is condensed to a sub-cooled liquid in the condenser 5 (which thus acts as a refrigerant-air heat exchanger) at a temperature equal or close to a saturation temperature at a bubble point of the refrigerant R for that pressure. Then reaching an expansion valve 7, the refrigerant R expands to a low pressure level reaching a bi-phase state at a temperature equal or close to the saturation temperature at a dew point of the refrigerant R for that pressure and then evaporates in the evaporator 4 (which thus acts as an air-refrigerant heat exchanger) to reach the superheated gas status again.

The condensate C is collected in a condensate container 8 or condensate tank, e.g. in a water collection tray or pan. From the condensate container 8, the condensate C is removed e.g. to a flush container or to an outlet (not illustrated). The removal may be effected by using a water pump (not illustrated). However, fluff, hair etc. that is contained in the condensate C may end up in the condensate container 8. Although part of this fluff etc. is removed from the condensate container 8 with the condensate, some other part remains and settles or agglomerates in the condensate container 8. Particularly the agglomerated fluff may sustain bio-films, if allowed. The condensate container 8 may be part of a bottom group and may thus not be removable by an end user.

Operation of the heat pump clothes dryer 1 may be controlled by a control means, e.g. a central control circuitry 9, e.g. comprising a microcontroller, an ASIC, a FPGA or such.

Figure 2:
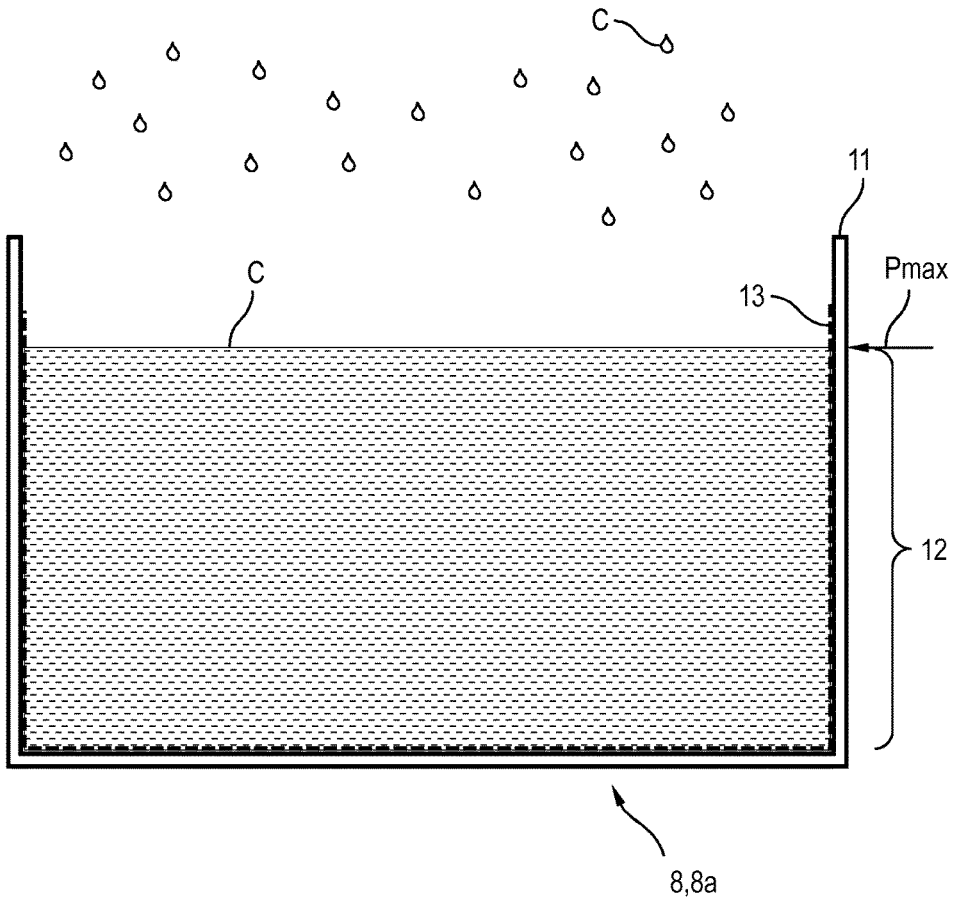
FIG. 2 illustrates a cross-sectional view of a sketch of the fluid container of FIG. 1, in accordance with embodiments.

FIG. 2 illustrates a sketch of one possible condensate container 8*a* in accordance with a first embodiment which can be used as the condensate container 8. The condensate container 8*a* has a pan-shaped plastic body 11 that can be filled with the condensate C as the fluid up to a maximum filling level Pmax. The region of the condensate container 8*a* that actually holds the condensate C may be referred to as a retaining region 12. At least the retaining region 12 is practically fully covered on the inside with a copper foil 13 acting as an oligodynamic surface and material, respectively. Thus, the condensate C is in large-scale contact with the copper foil 13. This inhibits formation of bio-films in the condensate container 8*a*, even when the copper foil 13 is used passively, i.e., not as an electrode.

Not illustrated, but in practice present, may e.g., be a water outlet, a filling level sensor, a lid etc. The water outlet may be connected to a suction side of a water pump (not illustrated). A pressure side of the water pump may be connected to an outlet of the clothes dryer 1 or to another condensate container, e.g. a collection container connected to a downpipe.

Figure 3:
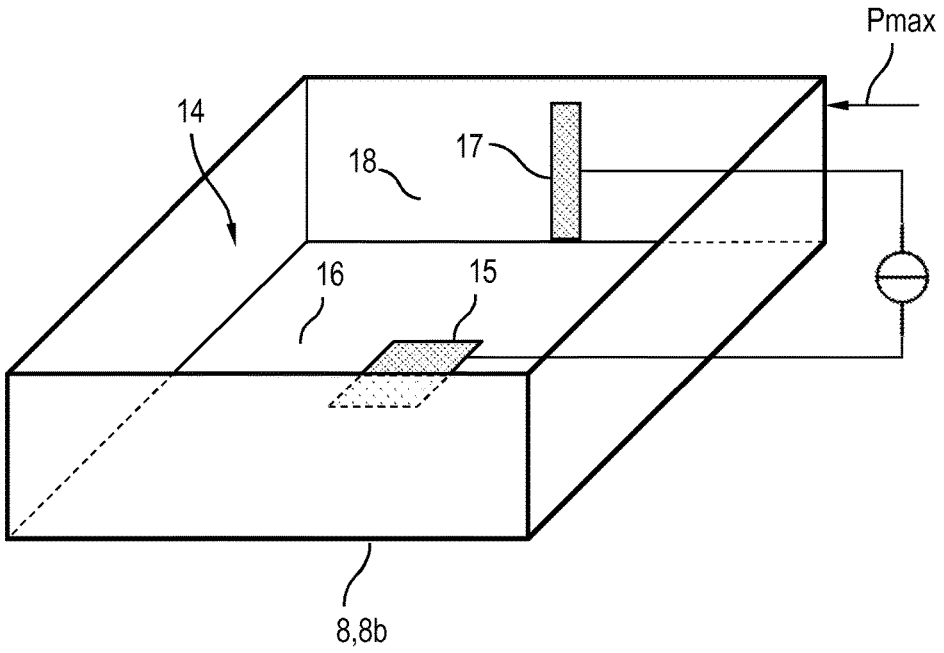
FIG. 3 illustrates a perspective view of a fluid container, in accordance with embodiments.

FIG. 3 illustrates a sketch of fluid container 8*b* in accordance with a second embodiment which also can be used as the condensate container 8. The condensate container 8*a* also has a pan-shaped plastic body 11 that can be filled with condensate C up to a maximum filling level Pmax. The respective retaining region 14 is only partially covered by a oligodynamic surface, in particular having a coverage of less than 50%, in particular of less than 20%. Rather, the inside area of the retaining region 14 comprises two separate copper electrodes, of which a first copper electrode 15 provide an oligodynamic surface and is centrally positioned at a bottom 16 of the retaining region 14 and a second electrode 17 is positioned at a side wall 18 of the retaining region 14. The clothes dryer 1 is adapted to apply an electric voltage and thus an electric current to the electrodes 15 and 17. The voltage is a DC voltage and may be constant or pulsation. The voltage and/or the current is set such it has an electrical charge between 10-9 and 3·10-3 C for one drying cycle.

The present invention is not limited to the described or illustrated embodiments.

The term "coupled" or "connected" may be used herein to refer to any type of relationship, direct or indirect, between the components in question, and may apply to electrical, mechanical, fluid, optical, electromagnetic, electromechanical or other connections. In addition, the terms "first," "second," etc. are used herein only to facilitate discussion, and carry no particular temporal or chronological significance unless otherwise indicated.

Those skilled in the art will appreciate from the foregoing description that the broad techniques of the embodiments may be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

LIST OF REFERENCE SYMBOLS

1 clothes dryer
2 drum
3 fan
4 evaporator
5 condenser
6 compressor
7 expansion valve
8 condensate container
8*a* condensate container
8*b* condensate container
9 control circuitry
11 pan-shaped body
12 retaining region
13 copper foil
14 retaining region
15 first electrode
16 bottom of the retaining region
17 second electrode
18 side wall of the retaining region
C condensate
H heat pump
L closed loop
P process air
R refrigerant

What is claimed is:

1. A household appliance, comprising:

a process air loop through which air is to flow;

a drum in communication with the process air loop, and which is to receive laundry that is to be dried;

a heat pump in communication with the process air loop to receive process air discharged by the drum;

at least one fluid container having a retaining region to collect and hold fluid removed from the process air by the heat pump, the retaining region having at least one oligodynamic surface; and at least one electrode positioned in an inside area of the retaining region, the at least one electrode having at least one oligodynamic surface.

2. The household appliance of claim 1, wherein the oligodynamic surface is composed of at least one element out of Group Ib of a periodic table.

3. The household appliance of claim 1, wherein the at least one electrode is to receive an electric current to decompose the at least one oligodynamic surface.

4. The household appliance of claim 1, wherein the retaining region is predominantly covered by the at least one oligodynamic surface.

5. The household appliance of claim 1, wherein the household appliance comprises a clothes drying appliance.

6. The household appliance of claim 1, wherein the at least one fluid container comprises a condensate container.

7. A clothes dryer, comprising:

a process air loop through which air is to flow;

a heat pump in communication with the process air loop to receive process air discharged by the drum;

at least one fluid container having a retaining region to hold fluid removed from the process air by the heat pump; and at least one electrode positioned in an inside area of the retaining region, the at least one electrode having an oligodynamic surface which is configured to receive an electric current having a predetermined electrical charge to electrolytically decompose the oligodynamic surface.

8. The clothes dryer of claim 7, wherein the at least one fluid container comprises a condensate container.

9. The clothes dryer of claim 7, wherein the at least one electrode is positioned at a side wall of the retaining region.

10. The clothes dryer of claim 7, wherein the at least one electrode is positioned at a bottom wall of the retaining region.

11. The household appliance of claim 1, wherein the at least one electrode is positioned at a side wall of the retaining region.

12. The household appliance of claim 1, wherein the at least one electrode is positioned at a bottom wall of the retaining region.

13. A clothes dryer, comprising:

a process air loop through which process air is to flow;

a drum in communication with the process air loop, and which is to receive laundry that is to be dried;

a heat pump in communication with the process air loop and the drum; and a fluid container having a fluid container body to collect condensate removed from the process air by the heat pump, the fluid container body having a retaining region to collect and hold the condensate, the retaining region covered on an inside area thereof with at least one electrode having an oligodynamic surface which is to contact the condensate collected by the retaining region.

14. The clothes dryer of claim 13, wherein the at least one electrode is composed of at least one element out of Group Ib of a periodic table.

15. The clothes dryer of claim 13, wherein the at least one electrode is positioned at a side wall of the retaining region.

16. The clothes dryer of claim 13, wherein the at least one electrode is positioned at a bottom wall of the retaining region.

17. The clothes dryer of claim 13, wherein the at least one electrode is positioned at a bottom wall of the retaining region and a side wall of the retaining region.

* * * * *